US010215405B2

(12) United States Patent
Kim et al.

(10) Patent No.: US 10,215,405 B2
(45) Date of Patent: Feb. 26, 2019

(54) COOKING DEVICE AND BURNER

(71) Applicant: LG ELECTRONICS INC., Seoul (KR)

(72) Inventors: Yangho Kim, Seoul (KR); Youngsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 223 days.

(21) Appl. No.: 15/008,165

(22) Filed: Jan. 27, 2016

(65) Prior Publication Data

US 2016/0215976 A1 Jul. 28, 2016

(30) Foreign Application Priority Data

Jan. 28, 2015 (KR) ..... 10-2015-0013355

(51) Int. Cl.
*F23N 5/10* (2006.01)
*F23D 14/04* (2006.01)
*F23D 14/72* (2006.01)

(52) U.S. Cl.
CPC ..... *F23D 14/725* (2013.01); *F23D 14/04* (2013.01); *F23D 14/72* (2013.01); *F23N 5/10* (2013.01); *F23N 5/105* (2013.01)

(58) Field of Classification Search
None
See application file for complete search history.

(56) References Cited

U.S. PATENT DOCUMENTS 3,051,813 A * 8/1962 Busch ..... G05D 23/1906 219/448.14
3,825,398 A * 7/1974 Katchka ..... F23D 14/725 431/285
4,646,963 A * 3/1987 Delotto ..... F24C 3/126 126/39 G
4,770,545 A * 9/1988 Takada ..... G01K 1/08 136/221
5,492,469 A * 2/1996 Oda ..... F23D 14/06 431/263
5,945,017 A * 8/1999 Cheng ..... F23D 14/76 219/446.1
5,961,311 A * 10/1999 Moore, Jr. ..... F23N 5/123 126/39 E (Continued)

FOREIGN PATENT DOCUMENTS

GB 2272283 A * 11/1994
KR 19980010744 U 3/1999

(Continued)

OTHER PUBLICATIONS

Machine translation of KR101452135.*

*Primary Examiner* — Avinash A Savani
*Assistant Examiner* — Martha M Becton
(74) *Attorney, Agent, or Firm* — Dentons US LLP

(57) ABSTRACT

A cooking device is provided. The cooking device includes a burner body having a nozzle to supply a gas, a burner head provided above the burner body, and having a mixed gas chamber in which air and the gas injected from the nozzle are introduced. a burner cap provided on the burner head, a flame remaining chamber provided at the burner head and separated from the mixed gas chamber, and a flame detection unit to pass through the burner head and located at the flame remaining chamber.

16 Claims, 9 Drawing Sheets

(56) References Cited

U.S. PATENT DOCUMENTS

| | | | | |
|---|---|---|---|---|
| 6,132,205 | A * | 10/2000 | Harneit | F23D 14/06 126/39 E |
| 6,780,009 | B2 * | 8/2004 | Harneit | F23D 14/065 126/39 E |
| 7,291,009 | B2 * | 11/2007 | Kamal | F23D 14/06 126/39 E |
| 7,841,332 | B2 * | 11/2010 | Pottenger | F23D 14/06 126/39 E |
| 9,074,765 | B2 * | 7/2015 | Armanni | F23D 14/065 |
| 9,341,380 | B2 * | 5/2016 | Vaglica | F24C 3/103 |
| 9,528,708 | B2 * | 12/2016 | Lim | F24C 3/08 |
| 9,696,039 | B2 * | 7/2017 | Cadima | F24C 3/126 |
| 2006/0121402 | A1 * | 6/2006 | Bettinzoli | F23D 14/06 431/354 |
| 2007/0128563 | A1 * | 6/2007 | Subramanian | H01C 7/008 431/278 |
| 2011/0056480 | A1 * | 3/2011 | Dorwarth | F23D 14/06 126/39 R |
| 2012/0152230 | A1 * | 6/2012 | Armanni | F23D 14/065 126/39 E |
| 2014/0345597 | A1 * | 11/2014 | Lim | F24C 3/08 126/39 E |

FOREIGN PATENT DOCUMENTS

| | | | |
|---|---|---|---|
| KR | 100693480 | B1 | 3/2007 |
| KR | 101301436 | B1 | 8/2013 |
| KR | 101452135 | B1 | 10/2014 |

* cited by examiner

COOKING DEVICE AND BURNER

CROSS-REFERENCE TO RELATED APPLICATION

This application claims priority under 35 U.S.C. § 119 and 35 U.S.C. § 365 to Korean Patent Application No. 10-2015-0013355, filed in Korea on Jan. 28, 2015, which is hereby incorporated by reference.

BACKGROUND

1. Field

The present disclosure relates to a cooking device and a burner.

2. Background

A cooking device is a device which cooks food by heating the food using a heat source.

An example of a conventional combustion-type cooking apparatus is provided in Korean Patent Publication No. 2013-0037851 (published on Apr. 17, 2013). Korean Patent Publication No. 2013-0037851 describes a combustion apparatus that includes a burner, and a thermocouple to detect a combustion state of the burner. The thermocouple is located close to the burner. The thermocouple may detect the flame, and when the thermocouple may not detect the flame, an electromagnetic valve of the burner may be blocked.

According to Korean Patent Publication No. 2013-0037851, when a calorific value generated from the burner is large, the flame may be prevented from being extinguished by external air or external pressure. However, when the calorific value is small (e.g., when the flame is relatively small), the flame may be extinguished by the external air or the external pressure. In such case, the thermocouple may not detect the flame, and thus the electromagnetic valve may be blocked.

SUMMARY

The present disclosure is directed to an improved cooking device and a burner which are able to prevent a flame from being extinguished even in a low calorific mode, and preferably to also continuously detect the flame.

According to an embodiment of the invention, a burner comprises a burner body having a nozzle to supply a gas, a burner head provided above the burner body and having a mixed gas chamber in which air and the gas injected from the nozzle are introduced, a burner cap provided on the burner head, a flame remaining chamber provided at the burner head and separate from the mixed gas chamber, and a flame detection unit provided at the flame remaining chamber.

According to another embodiment of the invention, a cooking device comprises a burner body, a burner head provided on the burner body, where in the burner head comprises, a mixed gas chamber in which a mixed gas of a gas and air is accommodated, a flame remaining chamber which is separate from the mixed gas chamber, a burner cap to cover top surfaces of the mixed gas chamber and the flame remaining chamber, an ignition unit to ignite the mixed gas supplied to the mixed gas chamber, a flame detection unit provided at least partially in the flame remaining chamber to detect a flame of the flame remaining chamber, a gas valve to control a flow of the gas to be supplied to the burner body, and a control unit to control the gas valve.

It is to be understood that both the foregoing general description and the following detailed description of the invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Advantages, features, and methods for achieving those of embodiments may become apparent upon referring to embodiments described later in detail together with the attached drawings. However, embodiments are not limited to the embodiments disclosed hereinafter, but may be embodied in different modes. The same reference numbers may refer to the same elements throughout the specification.

Figure 1:
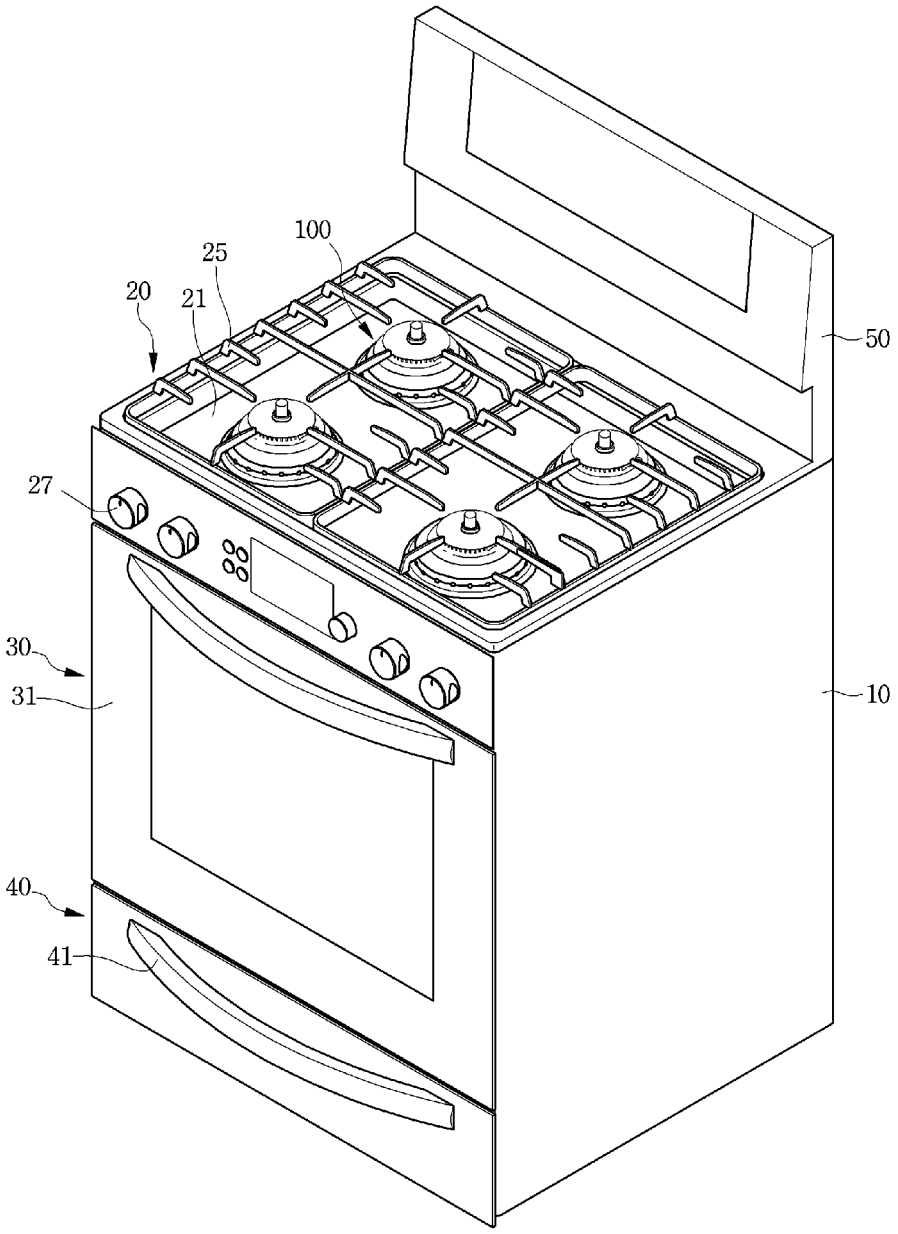
FIG. 1 is a perspective view of a cooking device according to an embodiment of the present disclosure.

Referring to FIG. 1, a cooking device according to an embodiment of the present disclosure may include a cabinet 10, a cook-top unit 20 provided at cabinet 10, and an oven unit 30. The cooking device may further include a control panel 50 that may be further provided at cabinet 10. The cabinet 10 may further include a drawer unit 40.

The cook-top unit 20 may be provided at an upper portion of cabinet 10. An upper surface of cook-top unit 20 may be formed by a top plate 21. The cook-top unit 20 may include one or more burners 100. A portion of the one or more burners 100 may be located above the top plate 21.

FIG. 1 illustrates an example in which four burners 100 are provided. However, it is understood that the number of burners 100 is not so limited.

Also, in the embodiment, oven unit 20 and drawer unit 40 may be omitted, and cooking device may have more than one of burners 100.

The burner 100 generates a flame by burning a mixed gas in which air and a gas are mixed, and heats food or other items. A detailed structure of burner 100 is described below.

The cook-top unit 20 may include one or more grates 25. The grates 25 may support the food or item which is heated by burner 100. Also, cook-top unit 20 may include an operation unit 27 to operate burner 100. In a non-limiting example, operation unit 27 may be a rotatable knob, a mechanical button, or a touch unit which receives a user's touch command.

The oven unit 30 may be provided under cook-top unit 20. An oven chamber (not shown) in which the food or item is cooked may be provided at oven unit 30. The oven chamber may be configured with an oven door 31, such that the oven chamber can be selectively opened and closed by the oven door 31. Although not illustrated, a heating source to heat the food or item, e.g., at least one of a broil burner, a bake burner and a convection device, may be provided inside of the oven chamber.

The drawer unit 40 may be provided below oven unit 30. The drawer unit 40 operates to warm food or items inserted therein. The drawer unit 40 may be inserted into and withdrawn from the cabinet 10 (e.g., pushed into and pulled from), and may include a drawer 41 in which the food or item may be accommodated.

The control panel 50 may be provided at a rear end of an upper surface of cabinet 10. The control panel 50 may receive a signal to operate oven unit 30 and drawer unit 40, and may also display information of an operation of oven unit 30 and drawer unit 40.

Figure 2:
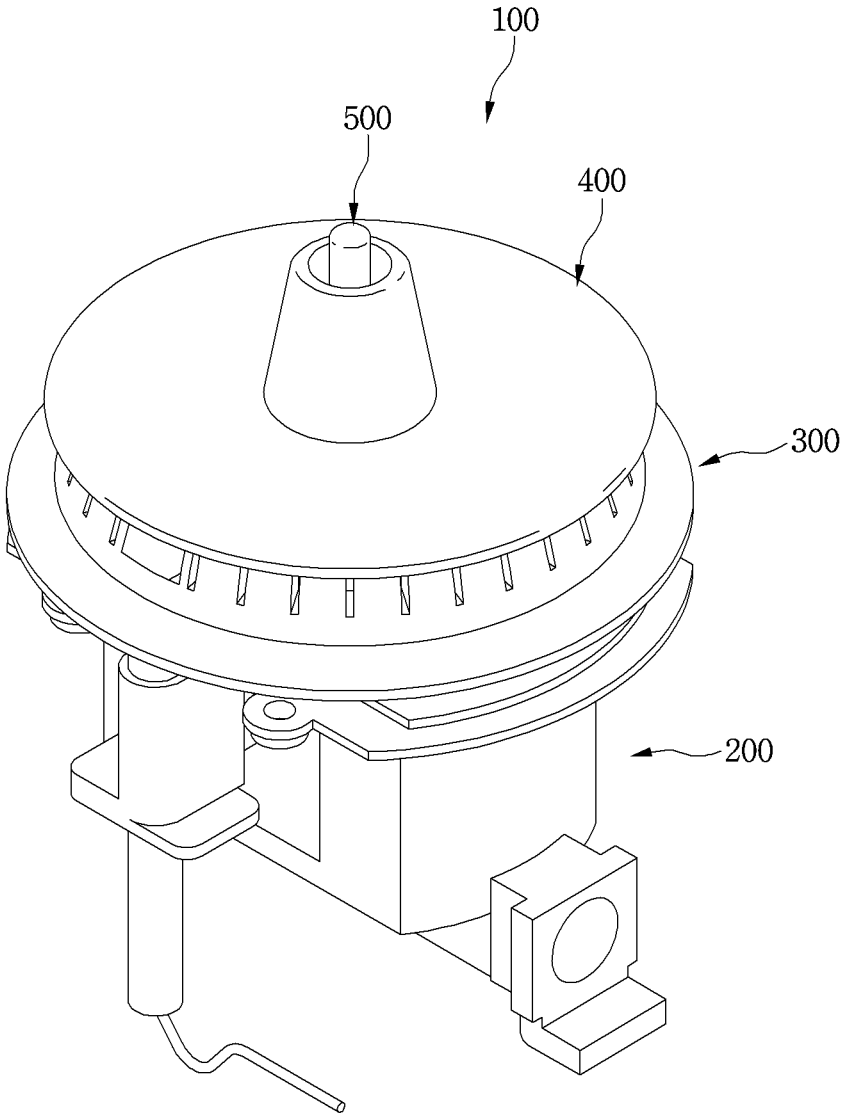
FIG. 2 is a perspective view of a burner according to an embodiment of the present disclosure.
Figure 3:
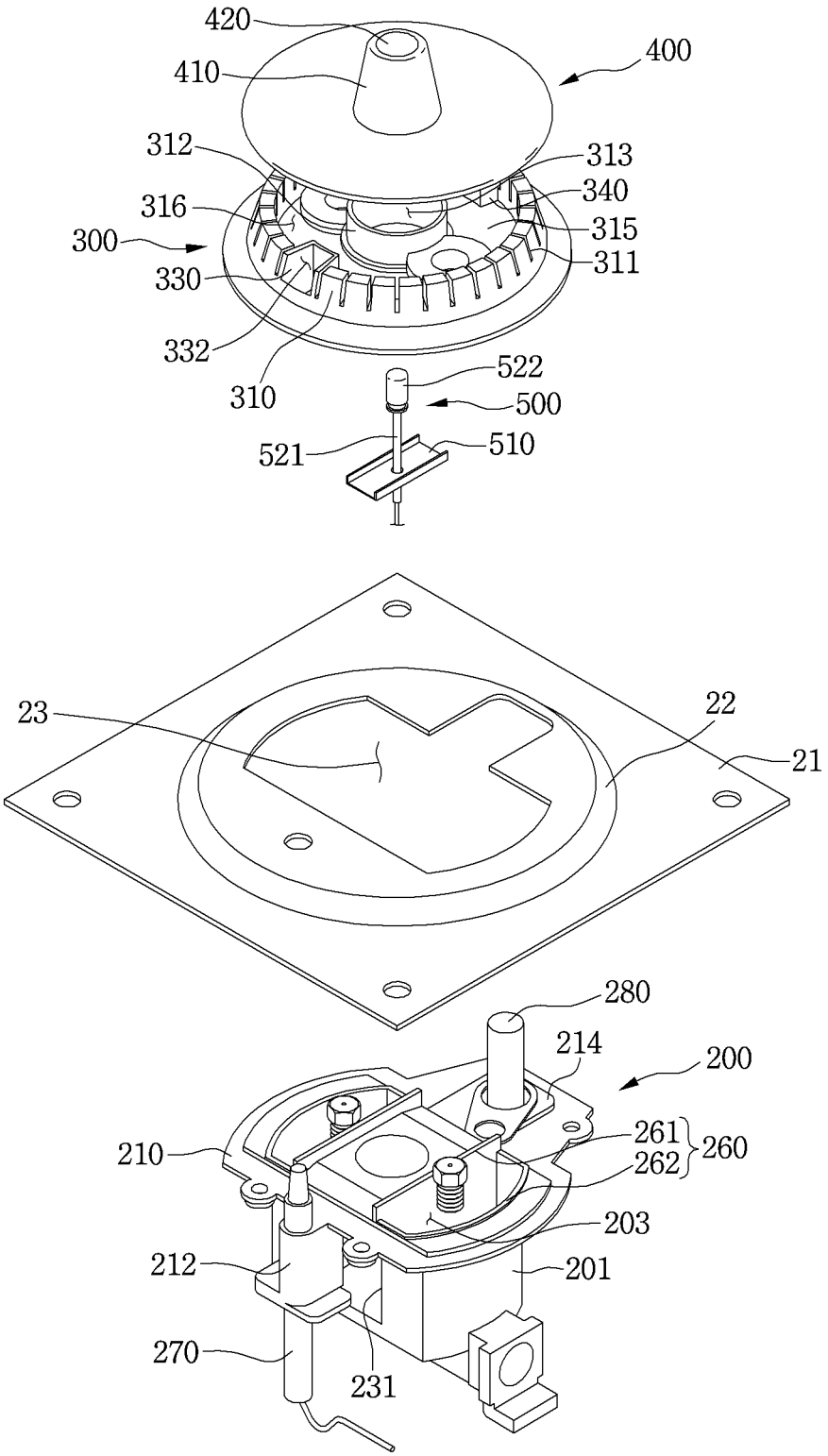
FIG. 3 is an exploded perspective view of the burner of FIG. 2.
Figure 4:
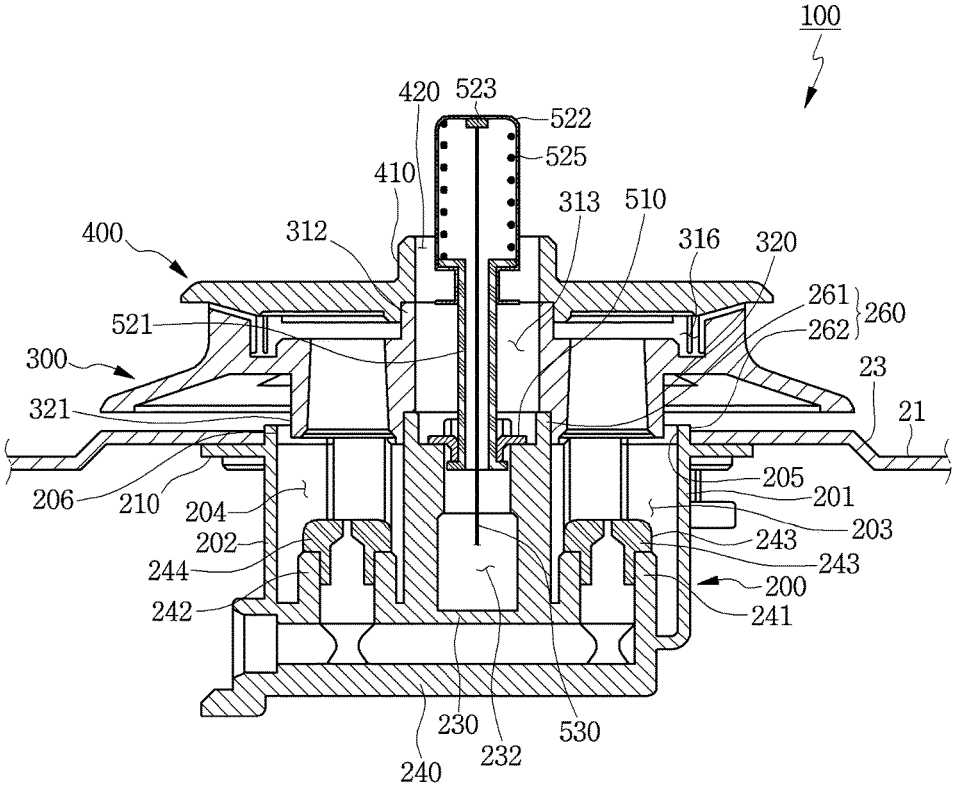
FIG. 4 is a longitudinal cross-sectional view of the burner according to an embodiment of the present disclosure.

FIG. 2 is a perspective view of a burner according to an embodiment of the present disclosure, FIG. 3 is an exploded perspective view of the burner of FIG. 2, and FIG. 4 is a longitudinal cross-sectional view of the burner.

Referring to FIGS. 2, 3, and 4, a burner seating part 22 may be provided at the top plate 21. The burner seating part 22 may be formed by recessing upward a part of the top plate 21. An installation opening 23 may be formed at burner seating part 22. For example, installation opening 23 may be formed by cutting away a portion of the top plate 21 that corresponds to burner seating part 22. The burner 100 may be installed through the installation opening 23, and the number of installation openings 23 may correspond to the number of burners 100.

The burner 100 generates a flame to heat the food or item by burning the mixed gas in which the gas and the air are mixed. As shown, burner 100 may include a burner body 200, a burner head 300, and a burner cap 400. The burner body 200 may be attached to a bottom surface of top plate 21 and/or bottom surface of the burner seating part 22.

The burner body 200 may include frames 201 and 202 which form gas supply chambers 203 and 204. However, it is understood that the number of frames 201 and 202 is not limited to any particular number.

As shown, the burner body 200 may include a first frame 201 and a second frame 202. The first frame 201 may form a first gas supply chamber 203, and the second frame 202 may form a second gas supply chamber 204. The first frame 201 and the second frame 202 may divide the first gas supply chamber 203 and the second gas supply chamber 204. The first frame 201 and the second frame 202 may be spaced apart from each other, and may be connected to each other by a connection part 230.

The burner body 200 may further include a flange 210. As shown, flange 210 may horizontally extend from a perimeter of each of the first and second frames 201 and 202. The first frame 201 and the second frame 202 may be spaced apart from each other, and the flange 210 may connect the first frame 201 with the second frame 202.

It is understood that while flange 210 is in contact with a lower surface of top plate 21, a fastening member (not shown) may attach the flange 210 to the top plate 21. For example, flange 210 may be fastened to burner seating part 22.

The first frame 201 may include a first air supply opening 205, and second frame 202 may include a second air supply opening 206. The air outside burner body 200 may be introduced into first gas supply chamber 203 through first air supply opening 205, and may also be introduced into second gas supply chamber 204 through second air supply opening 206.

The burner body 200 may further include a gas supply part 240 in which the gas which will be supplied to the first and second gas supply chambers 203 and 204 in the first and second frames 201 and 202 flows.

The gas supply part 240 may be provided at a lower side of each of the first and second frames 201 and 202.

A first nozzle holder 241 may be provided at the first frame 201, and a second nozzle holder 242 may be provided at the second frame 202. A first nozzle 243 may be attached to the first nozzle holder 241, and a second nozzle 244 may be attached to the second nozzle holder 242.

The first nozzle 243 may inject the gas to the first gas supply chamber 203, and the second nozzle 244 may inject the gas to the second gas supply chamber 204.

The burner 100 may further include a sensor 500 to detect a temperature of the container in which the food or item is placed.

The burner body 200 may further include a sensor accommodation part 232 to accommodate the sensor 500.

The sensor accommodation part 232 may be provided between first frame 201 and second frame 202. That is, sensor accommodation part 232 may be provided between the first gas supply chamber 203 and the second gas supply chamber 204.

The burner body 200 may further include a withdrawing opening 231. A wire 530 which is connected to sensor 500 may be withdrawn through withdrawing opening 231.

The withdrawing opening 231 may be formed by spacing first frame 201 and second frame 202 apart from each other.

The withdrawing opening 231 may discharge foreign substances introduced into burner body 200 to an outside location. That is, the foreign substances introduced into sensor accommodation part 232 may be discharged to a location that is outside of burner body 200 through withdrawing opening 231.

The burner body 200 may further include a barrier member 260. The barrier member 260 is configured to prevent the foreign substances, e.g., food or water overflowing from the container, from being introduced into the first and second gas supply chambers 203 and 204. The barrier member 260 may extend upward from an upper end of each of the first and second frames 201 and 202 or flange 210.

The barrier member 260 may be integrally formed with the burner body 200, or may be formed separately from burner body 200, and then may be fixed to burner body 200.

The barrier member 260 may include a first barrier member 261 and a second barrier member 262. The first barrier member 261 is provided at a portion of an edge of each of the first and second air supply openings 205 and 206. The second barrier member 262 is provided at the remaining portion of the edge of each of the first and second air supply openings 205 and 206, except the part of the edge of each of the first and second air supply openings 205 and 206 at which first barrier member 261 is located.

A height of first barrier member 261 may be higher than that of second barrier member 262. The first barrier member 261 may be in contact with a bottom surface of burner head 300, and second barrier member 262 may be spaced apart from the bottom surface of burner head 300. That is, burner head 300 may be provided on first barrier member 261. Therefore, the first barrier member 261 may support burner head 300.

The height of the first barrier member 261 is formed higher than that of the second barrier member 262 so as to prevent the foreign substances from being introduced into the first and second gas supply chambers 203 and 204 through the first and second air supply openings 205 and 206 and also to allow the air to be sufficiently supplied into the first and second gas supply chambers 203 and 204 through the first and second air supply openings 205 and 206.

The burner 100 may further include a flame detection unit 270 to detect the flame. And the burner body 200 may further include a first installation part 212 at which flame detection unit 270 is installed.

For example, the first installation part 212 may be integrally formed with the flange 210. Alternatively, first installation part 212 may be attached to flange 210.

The burner 100 may further include an ignition unit 280 to ignite the mixed gas supplied to burner head 300. The burner body 200 may further include a second installation part 214 at which ignition unit 280 is installed.

For example, second installation part 214 may be integrally formed with flange 210. Alternatively, second installation part 214 may be attached to flange 210.

The second installation part 214 may be provided at an opposite side of the first installation part 212 based on sensor accommodation part 232.

The burner head 300 may include an outer wall 310, an inner wall 312, and a bottom wall 315 that connects outer wall 310 with inner wall 312. The outer wall 310, inner wall 312, and bottom wall 315 may form a mixed gas chamber 316.

A plurality of flame holes 311 to generate the flame may be provided at outer wall 310. For example, inner wall 312 may be formed in a cylindrical shape, and may have a sensor through-hole 313 formed therein. While burner head 300 is provided on burner body 200, sensor through-hole 313 may be aligned with sensor accommodation part 232 of burner body 200. Therefore, a part of sensor 500 may pass through sensor through-hole 313, and may be accommodated in sensor accommodation part 232 of burner body 200.

The sensor through-hole 313 and mixed gas chamber 316 may be divided by inner wall 312.

The burner cap 400 may be provided on inner wall 312. That is, inner wall 312 may support burner cap 400.

The burner head 300 may further include one or more mixing tubes 320 and 321. FIG. 4 illustrates an example in which two mixing tubes are provided at burner head 300.

The one or more mixing tubes 320 and 321 may include a first mixing tube 320 and a second mixing tube 321. The first mixing tube 320 may be aligned with first gas supply chamber 203, and second mixing tube 321 may be aligned with second gas supply chamber 204.

The gas injected to first gas supply chamber 203 and the air introduced into first gas supply chamber 203 are introduced into first mixing tube 320.

The gas injected to second gas supply chamber 204 and the air introduced into second gas supply chamber 204 are introduced into second mixing tube 321.

The air and gas introduced into the first and second mixing tubes 320 and 321 are mixed while flowing through the first and second mixing tubes 320 and 321. The mixed gas in the first and second mixing tubes 320 and 321 is supplied to mixed gas chamber 316.

Each of the first and second mixing tubes 320 and 321 may extend downward from bottom wall 315 of burner head 300. Also, a portion of each of the first and second mixing tubes 320 and 321 may extend in an upward direction from bottom wall 315. When a part of each of the first and second mixing tubes 320 and 321 extends in an upward direction from bottom wall 315, an upper end of each of the first and second mixing tubes 320 and 321 may be spaced apart from a bottom surface of burner cap 400.

The burner head 300 may further include a flame remaining chamber 332 to provide a space which allows remaining of the flame.

The flame remaining chamber 332 may be formed by the outer wall 310 and a chamber forming wall 330 located between the outer wall 310 and the inner wall 312.

The burner head 300 may further include an ignition unit accommodation part 340 to form a space in which the ignition unit 280 is located. The burner cap 400 may be provided on the burner head 300 and may cover the mixed gas chamber 316. For example, the burner cap 400 may be seated on the outer wall 310 and the inner wall 312.

The burner cap 400 may further include a sensor cover wall 410. The sensor cover wall 410 may extend in an upward direction from an upper surface of burner cap 400. The sensor cover wall 410 may surround the sensor 500. For example, the sensor cover wall 410 may include a sensor through-hole 420 through which sensor 500 passes.

The diameter of sensor through-hole 420 may be larger than that of sensor 500. Therefore, the sensor cover wall 410 may be spaced apart from sensor 500.

The sensor through-hole 420 of burner cap 400 may be aligned with sensor through-hole 313 of burner head 300. The sensor 500 may detect the temperature of the food or item, e.g., the container in which the food is put, that is heated by burner 100.

The sensor 500 may pass through sensor through-hole 420 of burner cap 400 and sensor through-hole 313 of burner head 300, and may be provided in sensor accommodation part 232 of the burner head 300.

The sensor 500 may be installed at burner body 200 by a fixing bracket 510. The fixing bracket 510 may be attached or fixed to one side of an outer surface of sensor 500. For example, fixing bracket 510 may be fixed to flange 210 of burner body 200. It is understood that the invention is not limited to any particular type of fastening mechanism, such as a fixing bracket.

A height of the sensor 500 with respect to the top plate 21 may be controlled. For example, t sensor 500 may include a fixing body 521 that is attached or fixed to fixing bracket 510, and a movable body 522 that is movably connected to fixing body 521. A sensor element 523 may be provided at movable body 522, and the wire 530 may be attached to the sensor element 523.

The movable body 522 may be supported by an elastic member 525. The elastic member 525 may provide an elastic force to move the movable body 522 in an upward direction towards movable body 522.

Therefore, sensor 500 is in a protruding state to above sensor cover wall 410 by elastic member 525, and when container is provided on grate 25, sensor 500 is pressed downward by the container, which lowers the height of the sensor 500.

In other words, when movable body 522 which protrudes above sensor cover wall 410 is pressed by the container, movable body 522 moves in a downward direction.

According to the embodiment, since movable body 522 is elastically supported by the elastic member, sensor 500 may be in contact with the container.

As another example, sensor 500 may be attached to fixing bracket 510 so that it moves in a vertical direction. The elastic member (not shown) may be provided at a lower side of the sensor 500. In this case, even though the container is rounded downward, sensor 500 may be moved in a downward direction, and thus may be in contact with the container, and the container may also be stably seated on the grate 25.

Figure 5:
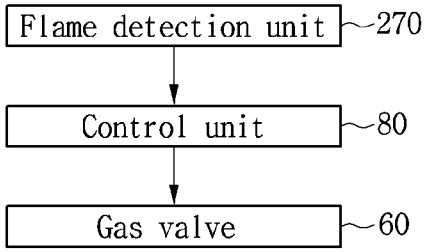
FIG. 5 is a configuration view of a cook-top unit according to an embodiment of the present disclosure.
Figure 6:
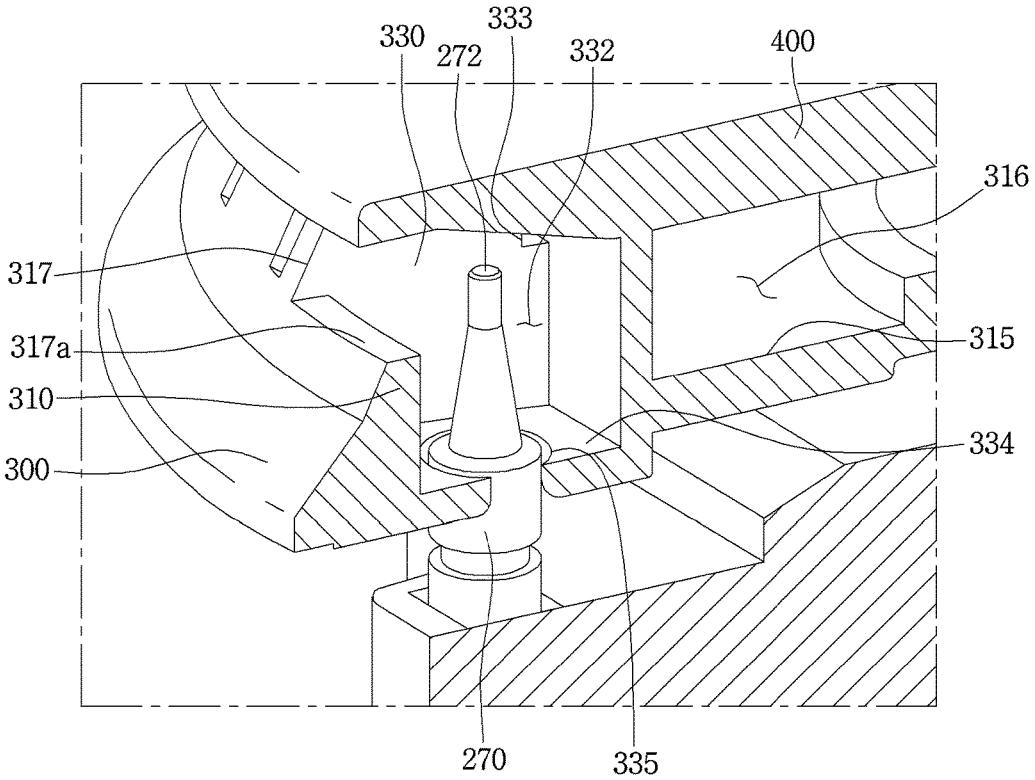
FIG. 6 is a view illustrating a state in which a flame detection unit is located at a flame remaining chamber according to an embodiment of the present disclosure.

FIG. 5 is a configuration view of the cook-top unit according to an embodiment of the present disclosure, and FIG. 6 is a view illustrating a state in which the flame detection unit is located at the flame remaining chamber according to an embodiment of the present disclosure.

Referring to the embodiments shown in FIGS. 1, 3, 5 and 6, the cook-top unit 20 may include a gas valve 60 to control a gas supply, a flame detection unit 270, and a control unit 80 which controls the gas valve 60 based on information detected by the sensor 500.

The control unit 80 closes gas valve 60 when the flame is not detected by flame detection unit 270 while gas valve 60 is opened. That is, the gas supply to burner 100 is cut off.

The control unit 80 may also close the gas valve 60 when the temperature detected by the sensor 500 exceeds a reference temperature.

The gas valve 60 may also control a flow rate of the gas supplied to burner 100. The calorific value of burner 100 may be varied depending on the flow rate of the gas supplied to burner 100. In general, the flame size increases as the calorific value of burner 100 increases. In other words, the flame size is larger when the calorific value of burner 100 is large than when the calorific value of burner 100 is small.

The user may control the calorific value of burner 100 using operation unit 27. For example, burner 100 may be operated in a high calorific mode, a low calorific mode, and one or more middle calorific modes.

Generally, the low calorific mode is a mode when the food is simmered, and may generally be referred to as a simmer mode.

When burner 100 is operated in the middle calorific mode or the high calorific mode, there is less possibility that the flame of burner 100 is extinguished by external air or pressure than when burner is operated in the low calorific mode. However, even when the flame of burner 100 is extinguished, the flame may remain in flame remaining chamber 332 of burner head 300.

If the flame of burner 100 is extinguished in the low calorific mode, and the flame is not detected by flame detection unit 270, gas valve 60 is closed, and thus the gas supply to burner 100 is cut off, and cooking is stopped.

Therefore, in the embodiment, flame detection unit 270 may be provided at flame remaining chamber 332 to enable the flame detection unit 270 to continuously detect the flame in the low calorific mode without an influence of the external air or pressure. In this case, flame detection unit 270 may continuously detect the flame even in the low calorific mode as well as the middle calorific mode and the high calorific mode.

The flame remaining chamber 332 may be formed by outer wall 310 and chamber forming wall 330. The chamber forming wall 330 may be integrally formed with outer wall 310. And chamber forming wall 330 may be spaced apart from inner wall 312. The flame remaining chamber 332 may be separated from mixed gas chamber 316 by chamber forming wall 330. The burner cap 400 may cover flame remaining chamber 332. Also, the burner cap 400 may cover an upper side of the flame detection unit 270 located at the flame remaining chamber 332.

The chamber forming wall 330 may include a mixed gas introduction hole 333 through which the mixed gas to generate the flame is introduced. The mixed gas in mixed gas chamber 316 is introduced into flame remaining chamber 332 through mixed gas introduction hole 333.

A hole 335 through which the flame detection unit 270 passes may be formed at a bottom wall 334 of the flame remaining chamber 332. The flame detection unit 270 may pass through hole 335 and be inserted into flame remaining chamber 332. In such arrangement, an upper end 272 of flame detection unit 270 may be located above bottom wall 334, and may be spaced apart from the bottom surface of burner cap 400.

The bottom wall 334 of flame remaining chamber 332 may be located below bottom wall 315 of mixed gas chamber 316. The will enable the flame to stably remain in flame remaining chamber 332.

The upper end 272 of flame detection unit 270 may be located above bottom wall 315 of mixed gas chamber 316. Since the flame of flame remaining chamber 332 is formed by the mixed gas introduced through mixed gas introduction hole 333, when upper end 272 of flame detection unit 270 is located above bottom wall 315 of mixed gas chamber 316, upper end 272 of flame detection unit 270 is positioned near mixed gas introduction hole 333, and thus flame detection unit 270 may stably detect the flame.

The outer wall 310 covers flame detection unit 270 located at flame remaining chamber 332. An air introduction port 317 which supplies the air so that the flame is stably kept in flame remaining chamber 332 may be provided at outer wall 310. In such arrangement, a bottom surface 317*a* of air introduction port 317 is positioned above bottom wall 334 of flame remaining chamber 332. Also, bottom surface 317*a* of air introduction port 317 may be positioned above bottom wall 315 of mixed gas chamber 316.

According to such embodiment, because flame detection unit 270 is provided at flame remaining chamber 332, it is possible to continuously detect the flame in the low calorific mode, middle calorific mode, and high calorific mode.

It is understood that even when the flame of flame holes 311 is extinguished at burner head 300, the flame may be propagated again by the flame of flame remaining chamber 332.

Figure 7:
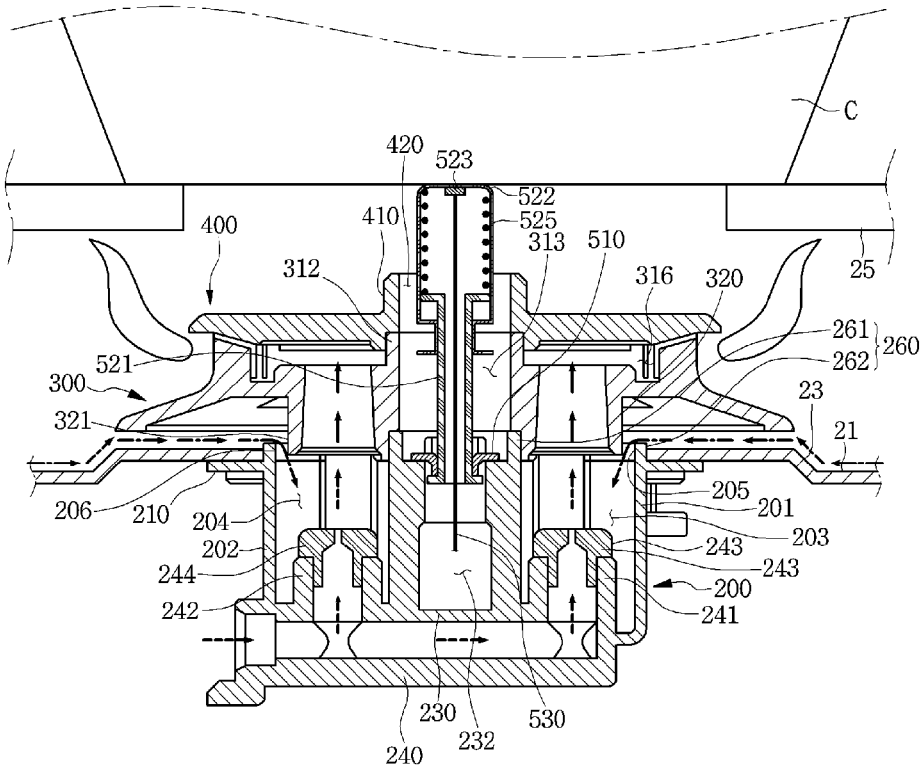
FIGS. 7 and 8 are views illustrating an operating state of the burner while a container is put on a grate according to an embodiment of the present disclosure.
Figure 8:
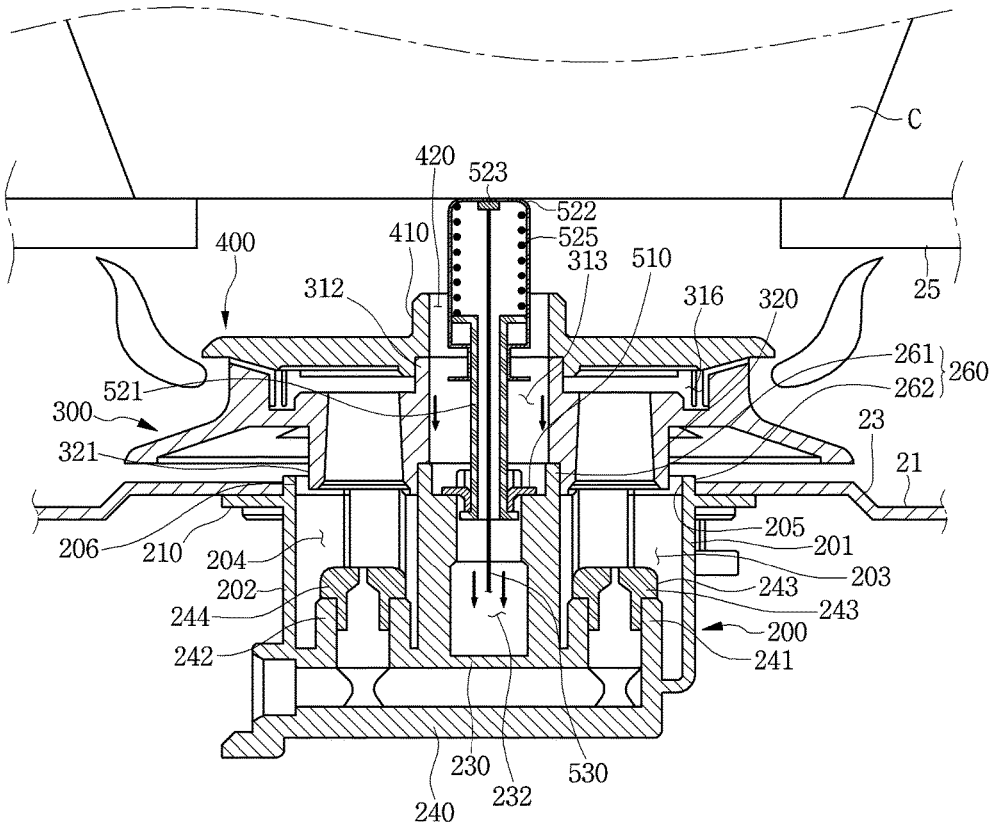

FIGS. 7 and 8 are views illustrating an operating state of the burner while the container is put on the grate according to an embodiment of the present disclosure.

Referring to FIGS. 7 to 8, a container C in which the food or items are contained is provided on grate 25. One side of a bottom surface of the container C seated on grate 25 may be in contact with sensor 500.

Accordingly, when the user operates operation unit 27, gas valve 60 is opened, and gas is supplied to gas supply part 240. The gas supplied from gas supply part 240 is injected to the gas supply chambers 203 and 204 through the first and second nozzles 243 and 244, while flowing through gas supply part 240.

The gas injected through the first and second nozzles 243 and 244 is transferred to the mixing tubes 320 and 321 together with the air in the gas supply chambers 203 and 204. At this time, the air flowing between an upper surface of burner seating part 22 and the bottom surface of burner head 300 is supplied into the gas supply chambers 203 and 204 through the first and second air supply openings 205 and 206. That is, there is a gap between burner seating part 22 and burner head 300, and the air flows therethrough.

At this time, the air introduced between burner seating part 22 and burner head 300 may flow to the mixing tubes 320 and 321, and may also flow to sensor accommodation part 232 and sensor through-holes 313 and 420, and may cool sensor 500.

The air supplied into gas supply chambers 203 and 204 through the first and second air supply openings 205 and 206 may flow through a space provided between the bottom surface of burner head 300 and second barrier member 262.

Then, the gas and the air transferred to mixing tubes 320 and 321 are mixed, while flowing through mixing tubes 320 and 321, and then supplied into mixed gas chamber 316. The mixed gas supplied into mixed gas chamber 316 is discharged through flame holes 311, and then ignited by ignition unit 280 operated by operation unit 27.

Therefore, container C is heated by the flame generated by burning the mixed gas, and thus the cooking of the food is substantially performed over conventional methods. The air flowing through a space between burner cap 400 and container C may be supplied toward flame holes 311. The flame may be propagated to flame remaining chamber 332, and flame detection unit 270 provided at flame remaining chamber 332 may detect the flame.

The flow of the gas through gas valve 60 may be controlled by operation unit 27, and flame detection unit 270 may also continuously detect the flame of flame remaining chamber 332. This is true even when burner 100 is operated in the low calorific mode.

Meanwhile, referring to FIG. 8, the food or item contained in the container C may overflow from container C. The food or item, e.g., a part of the foreign substances overflowing to the outside of container C, may flow through a gap between sensor 500 and sensor cover wall 410. However, in the disclosed embodiment, barrier member 260—the first and second barrier members 261 and 262—are provided at the edge portions of the first and second air supply openings 205 and 206, respectively. Accordingly, the foreign substances introduced through sensor through-holes 313 and 420 may be prevented by the first and second barrier members 261 and 262 from being introduced into the gas supply chambers 203 and 204.

Furthermore, in the disclosed embodiment, contamination of the first and second nozzles 243 and 244 due to the foreign substances being introduced into the gas supply chambers 203 and 204 may be prevented or substantially reduced.

Therefore, in the disclosed embodiment, since gas is precisely injected through the first and second nozzles 243 and 244, the burning of the gas by burner 100 may be efficiently performed.

The foreign substances introduced through sensor through-holes 313 and 420 may also be introduced into sensor accommodation part 232. In the embodiment, the foreign substances introduced into sensor accommodation part 232 may be discharged to or cleaned by the user through withdrawing opening 231.

Meanwhile, when sensor 500 detects the temperature of the container, and the temperature detected by the sensor 500 reaches a reference temperature, control unit 80 may close gas valve 60 and may cut off the flow of gas.

Figure 9:
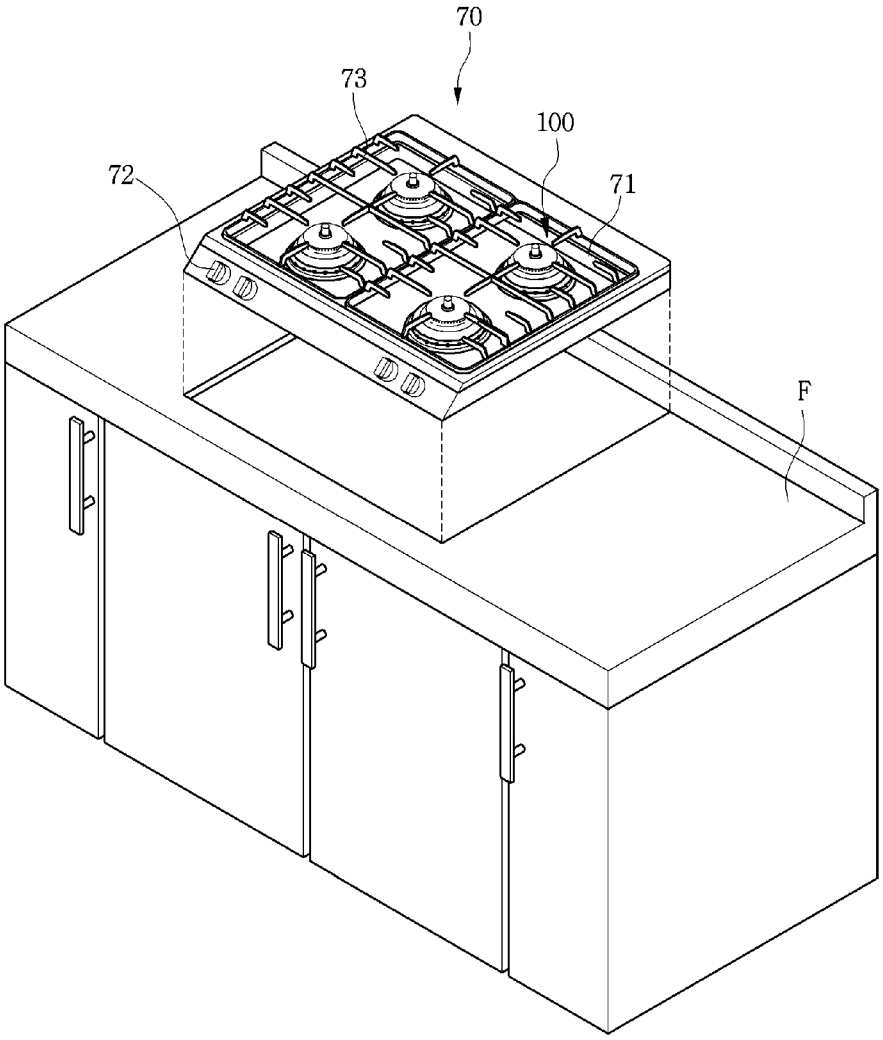
FIG. 9 is a perspective view of a cooking device according to another embodiment of the present disclosure.

FIG. 9 is a perspective view of a cooking device according to another embodiment of the present disclosure. Referring to FIG. 9, a cooking device 70 is installed at kitchen furniture F. The cooking device 70 may be, for example, a built-in gas cooking device.

An upper surface of cooking device 70 may be formed by a top plate 71. The top plate 71 may be provided on an upper surface of kitchen furniture F. A plurality of burners 100 may be installed at top plate 71. The burners described in the previous embodiment may be used as burners 100. Also, a plurality of operation units 72 to operate the burners 100 may be provided at a front end of top plate 71 corresponding to a front of burners 100. A plurality of grates 73 on which the food or item, (or container) is heated by the burner 100 are provided at an upper surface of the top plate 71.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A burner comprising:

a burner body having a nozzle to supply a gas;

a burner head provided above the burner body and having a mixed gas chamber in which air and the gas injected from the nozzle are introduced;

a burner cap provided on the burner head;

a flame remaining chamber provided at the burner head and separate from the mixed gas chamber; and a flame detection unit provided at the flame remaining chamber, wherein the burner head comprises an outer wall which has a flame hole, an inner wall which is located inside the outer wall, and a chamber forming wall spanning the outer wall and the inner wall to form the flame remaining chamber, wherein the flame detection unit is located between the outer wall and the inner wall, wherein the outer wall is extends above a bottom wall of the flame remaining chamber, wherein the burner body comprises:

a gas supply chamber through which the gas injected from the nozzle flows, a sensor accommodation part that is separate from the gas supply chamber, an air supply opening through which the air is introduced into the gas supply chamber, and a barrier member extending upward from an edge of the air supply opening and configured to prevent foreign substances from cooking activities from being introduced into the gas supply chamber, wherein the barrier member comprises:

a first barrier member which extends upward from a first portion of the edge of the air supply opening adjacent to the sensor accommodation part, and a second barrier which extends upward from a second portion of the air supply opening toward an top surface of the burner body and concentric to the first barrier member, wherein a height of first barrier member is higher than a height of the second barrier.

2. The burner of claim 1, wherein a hole through which the flame detection unit passes is provided at the bottom wall of the flame remaining chamber.

3. The burner of claim 1, wherein the chamber forming wall comprises a mixed gas introduction hole through which the mixed gas in the mixed gas chamber is introduced into the flame remaining chamber.

4. The burner of claim 1, wherein an air introduction port through which the air is introduced into the flame remaining chamber is provided at the outer wall of the burner head.

5. The burner of claim 1, wherein a bottom wall of the chamber forming wall is positioned below a bottom wall of the mixed gas chamber.

6. The burner of claim 5, wherein an top surface of the flame detection unit is positioned above the bottom wall of the mixed gas chamber.

7. The burner of claim 1, wherein the burner cap covers a top surface of the flame detection unit.

8. The burner of claim 1, further comprising a sensor provided in the burner body that passes through the burner head and the burner cap, and extends above the burner cap.

9. The burner of claim 1, wherein the first barrier member contacts a bottom surface of the burner head, and the second barrier member is spaced apart from the bottom surface of the burner head.

10. The burner of claim 1, wherein the burner body further comprises a withdrawing opening through which a substance that is introduced into the sensor accommodation part can be discharged.

11. The burner of claim 1, wherein the burner body further comprises a first installation part at which the flame detection part is provided.

12. The burner of claim 11, further comprising an ignition unit to ignite the mixed gas of the burner head, wherein the burner body further comprises a second installation part at which the ignition unit is provided and which is located at an opposite side of the first installation part in relation to the sensor accommodation part.

13. A cooking device comprising:

a burner body;

a burner head provided on the burner body, where in the burner head comprises:

a mixed gas chamber in which a mixed gas of a gas and air is accommodated, and a flame remaining chamber which is separate from the mixed gas chamber;

a burner cap to cover top surfaces of the mixed gas chamber and the flame remaining chamber;

an ignition unit to ignite the mixed gas supplied to the mixed gas chamber;

a flame detection unit provided at least partially in the flame remaining chamber to detect a flame of the flame remaining chamber;

a gas valve to control a flow of the gas to be supplied to the burner body; and a control unit to control the gas valve, wherein the burner head comprises an outer wall which has a flame hole, an inner wall which is located inside the outer wall, and a chamber forming wall spanning the outer wall and the inner wall to form the flame remaining chamber, wherein the flame detection unit is located between the outer wall and the inner wall, wherein the outer wall is extends above a bottom wall of the flame remaining chamber, wherein the burner body comprises:

a gas supply chamber through which the gas injected from the nozzle flows, a sensor accommodation part that is separate from the gas supply chamber, an air supply opening through which the air is introduced into the gas supply chamber, and a barrier member extending upward from an edge of the air supply opening and configured to prevent foreign substances from cooking activities from being introduced into the gas supply chamber, wherein the barrier member comprises:

a first barrier member which extends upward from a first portion of the edge of the air supply opening adjacent to the sensor accommodation part, and a second barrier which extends upward from a second portion of the air supply opening toward an top surface of the burner body and concentric to the first barrier member, wherein a height of first barrier member is higher than a height of the second barrier.

14. The cooking device of claim 13, further comprising a sensor that protrudes above the burner cap and detects a temperature, wherein the control unit controls the gas valve based on information detected by the sensor and information detected by the flame detection unit.

15. The cooking device of claim 14, wherein the flame detection unit, the sensor and the ignition unit are provided at the burner body, and the sensor is provided at a location between the flame detection unit and the ignition unit.

16. The cooking device of claim 13, wherein the flame detection unit passes through a bottom wall of the chamber forming wall and into the flame remaining chamber.

* * * * *